US005776041A

United States Patent [19]

Fisher

[11] Patent Number: 5,776,041

[45] Date of Patent: Jul. 7, 1998

[54] EXERCISE DEVICE WITH AN ELASTIC MEMBER

[76] Inventor: Karol Fisher, 179-10 Union Turnpike, Jamaica Estates, N.Y. 11366

[21] Appl. No.: 780,461

[22] Filed: Jan. 8, 1997

[51] Int. Cl.[6] ..... A63B 21/02

[52] U.S. Cl. ..... 482/125; 482/122; 482/124; 482/126

[58] Field of Search ..... 482/125, 121, 482/122, 124, 126

[56] References Cited

U.S. PATENT DOCUMENTS

| | | | |
|---|---|---|---|
| 3,531,113 | 9/1970 | Sherman et al. | 482/125 |
| 4,057,246 | 11/1977 | Wilson | 482/125 |
| 4,195,835 | 4/1980 | Hinds et al. | 482/125 |
| 4,304,402 | 12/1981 | Ripp | 482/125 |
| 4,316,610 | 2/1982 | Hinds | 482/125 |
| 4,733,861 | 3/1988 | Plunkett, III | 482/125 |
| 4,736,946 | 4/1988 | Gordon | 482/125 |
| 5,131,650 | 7/1992 | Hall | 482/125 |

*Primary Examiner*—Lynne A. Reichard

[57] ABSTRACT

A multipurpose exercise device includes a stiff bar terminating in limb engagement members and a flexible element connected to the center of the bar, extending away from the bar and being provided with its own limb engagement members. The bar can be positioned so that it engages the feet and the flexible member can be positioned to engage the hands or vice versa to perform a large array of exercises. Preferably the flexible member is elastic.

17 Claims, 6 Drawing Sheets

EXERCISE DEVICE WITH AN ELASTIC MEMBER

BACKGROUND OF THE INVENTION

A. Field of Invention

This invention pertains in general to the exercising devices, and more particularly to a devices which is simple to use and yet it is very versatile so that it can be used to perform several types of exercises without changing its configuration.

Description of the Prior Art

Exercising has become a favorite pastime not only in the United States but all over the world. More people are engaged in this activity then any other types of leisure. Of course most exercises performed today require various types of devices. Initially most devices, such as for example, the jumping rope, were quite simple. Another simple exercise device consisted of a bar with a single elastic rope three or four feet long and extending between the two ends so that a person could hold the bar and push down on the rope with his feet. A variation of this device consisted of the elastic rope with two handles at the ends of the rope replacing the bar.

However none of these prior art devices were very versatile since they could be used only for a very limited number or kinds of exercise. Slowly, exercising devices progressed to a point were many of them are very complicated, hard to use, expensive, and generally uncomfortable to use. Many of the present day devices consist of various combinations of mechanical devices such as support surfaces, seats, chairs, wheels, chains, ropes, pulleys, weights, bar bells and oddly shaped rods. A person from the Middle Ages would immediately recognize these devices for what they really are: torture tools.

As the size and complexity of these devices increased, they became more and more complicated to use, require a large space, special instructions, and very often should not be used without the supervision of specially trained professional personnel. Moreover, the devices may also require electrical power and are hazardous.

All these factors increase the cost of the devices to the point were they can be afforded only by very rich persons, and/or can be used only in gyms or health spas. Moreover, despite of, or possible because of their complexity, these devices can be used to perform only one exercise, or even if they are adaptable to more than one exercise at a time and require extensive and time consuming changes in configuration before they can be switched over to a different exercise. However, performing the same exercise over and over again is extremely monotonous and takes a lot of perseverance to continue. More importantly, a single exercise is beneficial only to a limited number of muscles, and at the same time. Performing the same exercise for a long time is detrimental because it tires the addressed muscles, while other muscles are neglected.

OBJECTIVES AND SUMMARY OF THE INVENTION

In view of the above, it is an objective of the present invention to provide a simple yet effective exercise device.

A further objective is to provide an exercise device which requires no changes in configuration but can be switched substantially instantaneously from one exercise to another.

Yet a further objective is to provide a device which can be easily changed in size or color coordinated for various people and hence can be customized for potential customers of specific age, sex, height, physical condition and preference.

Another objective is to provide a device that can be used virtually instantaneously, i.e., without any setup, virtually anywhere, i.e. home, office, park, beach, etc.

Yet a further objective is to provide a device which can be used in any position, including vertical and horizontal.

Yet a further objective is to provide an exercise device which can be made easily from readily available, and relatively inexpensive material so that it can be made cheaply and can be advantageously purchased and used by virtually everybody. Other objectives and advantages of the invention shall become apparent form the following description.

Briefly, an exercise device constructed in accordance with this invention consists of five major components: a bar and four flexible, elastic members made of a pliable material. Preferably the flexible members are provided at their ends with loops or other limb engaging elements for engaging the foot or the hand of the person as shall be described in more detail below, depending on the type of exercise that is to be performed.

DETAILED DESCRIPTION OF THE INVENTION

Figure 1:
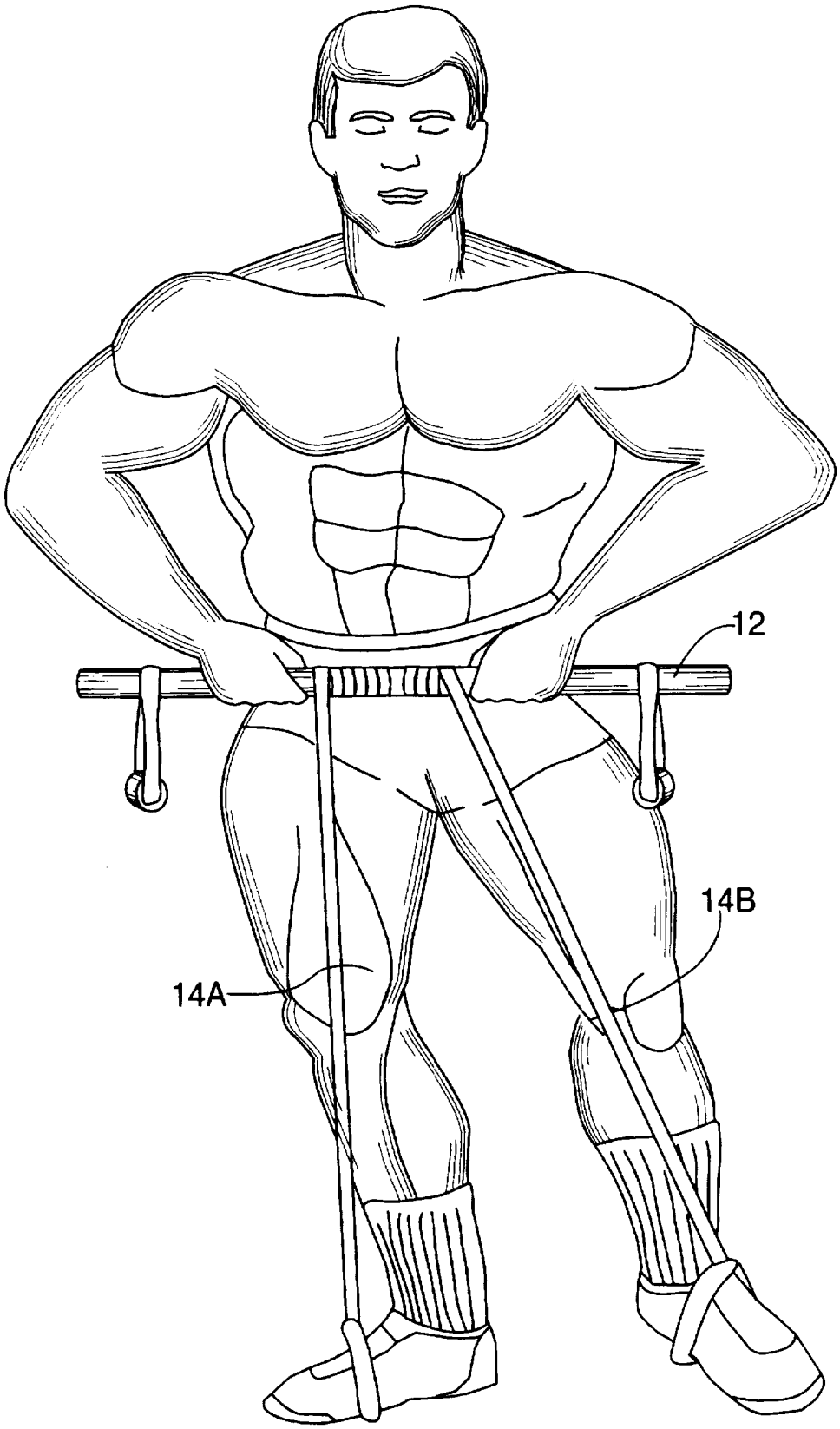
FIG. 1 shows a man using an exercise device constructed in accordance with this invention.

Referring now to FIG. 1, a man is shown in a frontal view using the exercise device 10, in accordance with this invention. The device 10 includes a bar 12 extending for this exercise between his arms, and accordingly the bar 12 is about three to four feet long. The device 10 further includes flexible elastic members 14A, 14B extending from the bar 12 to both his legs. In the embodiment and configuration shown the elastic members 14A, 14B extend from the center of the bar 12. Because the members 14A, 14B are flexible and elastic, the man can repeatedly pull the bar up to approximately his chest level. As the bar 12 moves up, the elastic member stretches out and it proportionally increases the force applied between the bar and the man's feet, and hence the forces that the man applies between his arms and legs also increase proportionally. Thus, both the muscles of the upper body, the arms, and the legs are all exercised simultaneously. In addition the abdominal muscle are also exercised. In fact the inventor has found that the subject invention is especially effective in exercising the abdominal muscles, when used for some of the other exercises described below. It is also important to note that these forces are applied by tension in members 14A, 14B which is self-induced in the device as a response to the movements of the arms and they are automatically adjusted and peak-limited by the user by merely changing the distance that the bar is moved. So, for example, a person in relatively poor physical condition can move the bar 12 upward only for a relatively short distance and hence the forces applied by the device are relatively small, allowing the user to perform this exercise repeatedly without excessive short term loads on the muscles. A person in a better physical condition automatically raises the bar 12 to a higher position thereby automatically increasing the forces applied to the various body muscles. Alternatively, or in addition, the person can pull the handles up on his arm near the elbow and perform the exercise in this modified position. Other means of adjusting or changing the forces generated by the device will also be described.

The exercise and configuration shown in FIG. 1 is merely one of many exercises that can be performed and has been described here in to provide a proper appreciation of the flexibility and simplicity of this device. Other exercises possible with this device shall be provided below, after a detailed discussion of the structure of the device 10.

Referring now to FIGS. 2–6, the bar 12 of device 10 is essentially a hollow, relatively stiff tube 20 made from a light but strong material such as PVC or aluminum. As previously mentioned, the bar 12, and hence tube 20 is about 3–4 feet long, and has preferably a diameter of about ¾–1". At each of its ends, the tube 20 is covered with two sleeves 22, 24 made of a relative soft material such as a synthetic sponge. The sleeves 22, 24 are sized in diameter and longitudinally so that they fit snugly over the tube 20 and can be easily grasped by a person. For example each of the sleeves 22, 24 may be about ¼–⅜" thick and extend axially for about 2–4".

For esthetic purposes, and to insure that dirt does not collect inside the tube 20, the ends of the tube are closed by caps 26.

The two sleeves 22, 24 are spaced apart to form annular grove. Between the two sleeves 22, 24, and the grove formed therebetween there is disposed a loop 28. Loop 28 is shaped somewhat like a figure eight with the top closed loop portion 30 being much smaller than the bottom portion 32. That is because the top portion 30 surrounds or disposed substantially completely about the tube 20. The top portion 30 is preferably secured to tube 20 by a suitable adhesive.

Figure 4:
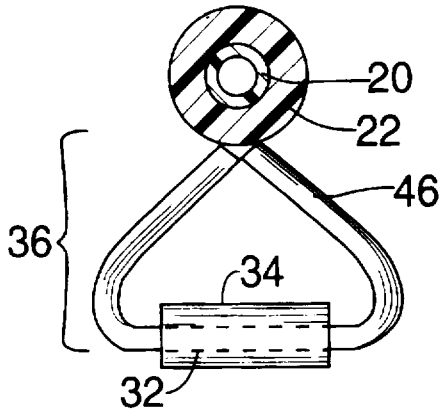
FIGS. 3, 4, 5 and 6 show cross sectional views taken along lines 3—3, 4—4, 5—5 and 6—6 in FIG. 2, respectively.
Figure 3:
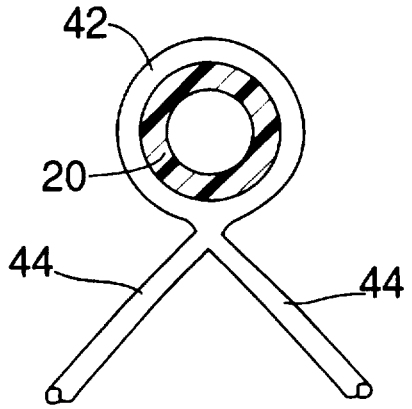

As best seen in FIG. 4, the bottom portion 32 of the loop 28 is somewhat flattened by a straight tube 34. Loop 28 may be made of a flexible inelastic material such as fabric. However preferably loop 28 is made of an elastic material. Tube 34 fits loosely about a section of the loop portion 32 and is made of a more rigid and stronger material then the loop 28. For example, the tube 34 may be made of a rubber or plastic material. Together the loop 28 and tube 34 cooperate to form a limb engaging or coupling element 36. That is, depending on the particular exercise, the engaging element may be used for engagement either with the hand or the feet of a person. There is a limb engaging element 36 provided adjacent to both ends of the bar 12.

Figure 2:
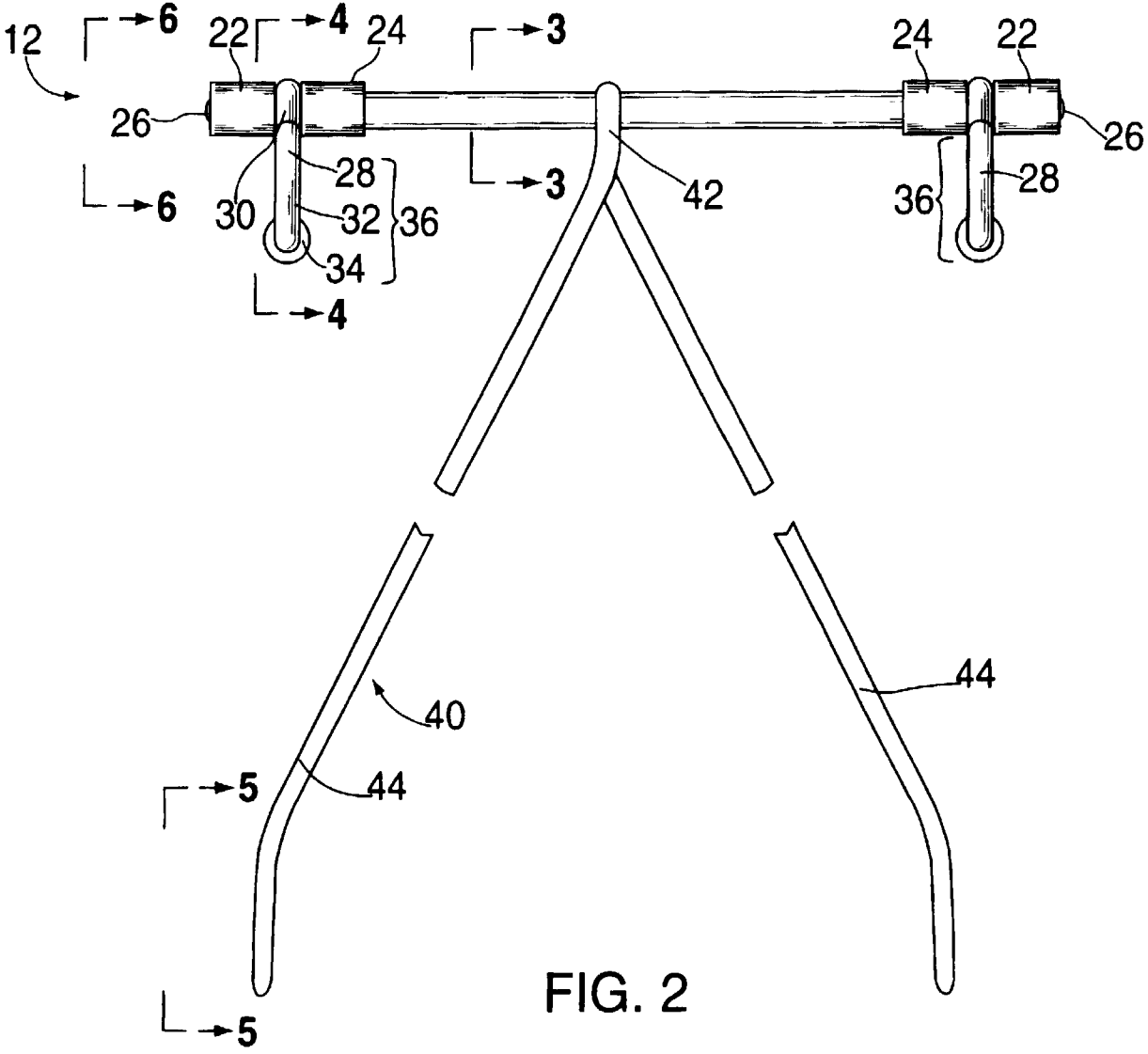
FIG. 2 shows a plan view of the subject device.

The elastic member 14 is essentially a hollow hose 40 having a central portion 42 and two identical free portions 44. Central portion 42 is wrapped about the tube 20. As seen in FIG. 2, preferably central portion 42 is disposed preferably at the middle of tube 20 half way between the sleeves 24. Central portion 42 is also secured to tube 20 by an adhesive such as a glue or contact cement. The adhesive to be use is dependent on the material of the tube 20 and the hose 40. Importantly, hose 40 must be fairly strong so that it can be used to apply a sufficient force for an effective exercise regime, and to last long. Although it may be possible to make the hose 14 out of textile or leather, it is preferred that it be made of a rubber such as for example Latex®.

Figure 5:
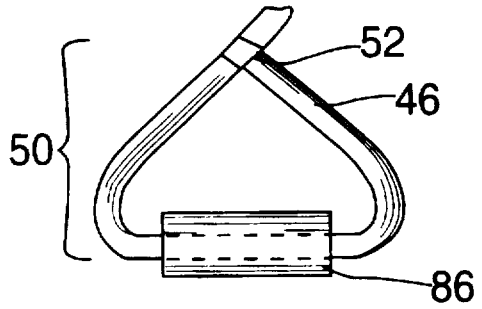
Figure 6:
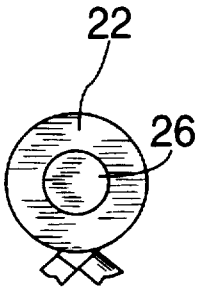

As best seen in FIG. 5, each hose portion 44 is doubled back on itself to form a loop 46. A tube 48 is also provided on the loop thus formed, similar to the tube 34. In this manner another limb engaging element 50 is formed, which is similar in size and shape to element 32. This may be accomplished for example by passing the end of each section 44 through the tube 48 and then securing the end onto a portion of the hose section 44 above the tube as shown for example at 52. Again, the connection 52 may be accomplished by using an appropriate adhesive. Alternatively, the hose end may be secured at 52 with an external means such as a clamp, a wire tie and so on.

Referring now back to FIG. 1, for the illustrated exercise, the man holds the bar 12 by the sleeves 22 while his feet are engaged by engaging elements 50. (For this exercise, the engaging elements 36 are idle). As seen in this figure, the hose sections 44 are preferably shorter than the distance from the center of the bar 12 to the man's feet thereby insuring that there is a minimum force is applied.

Figure 7:
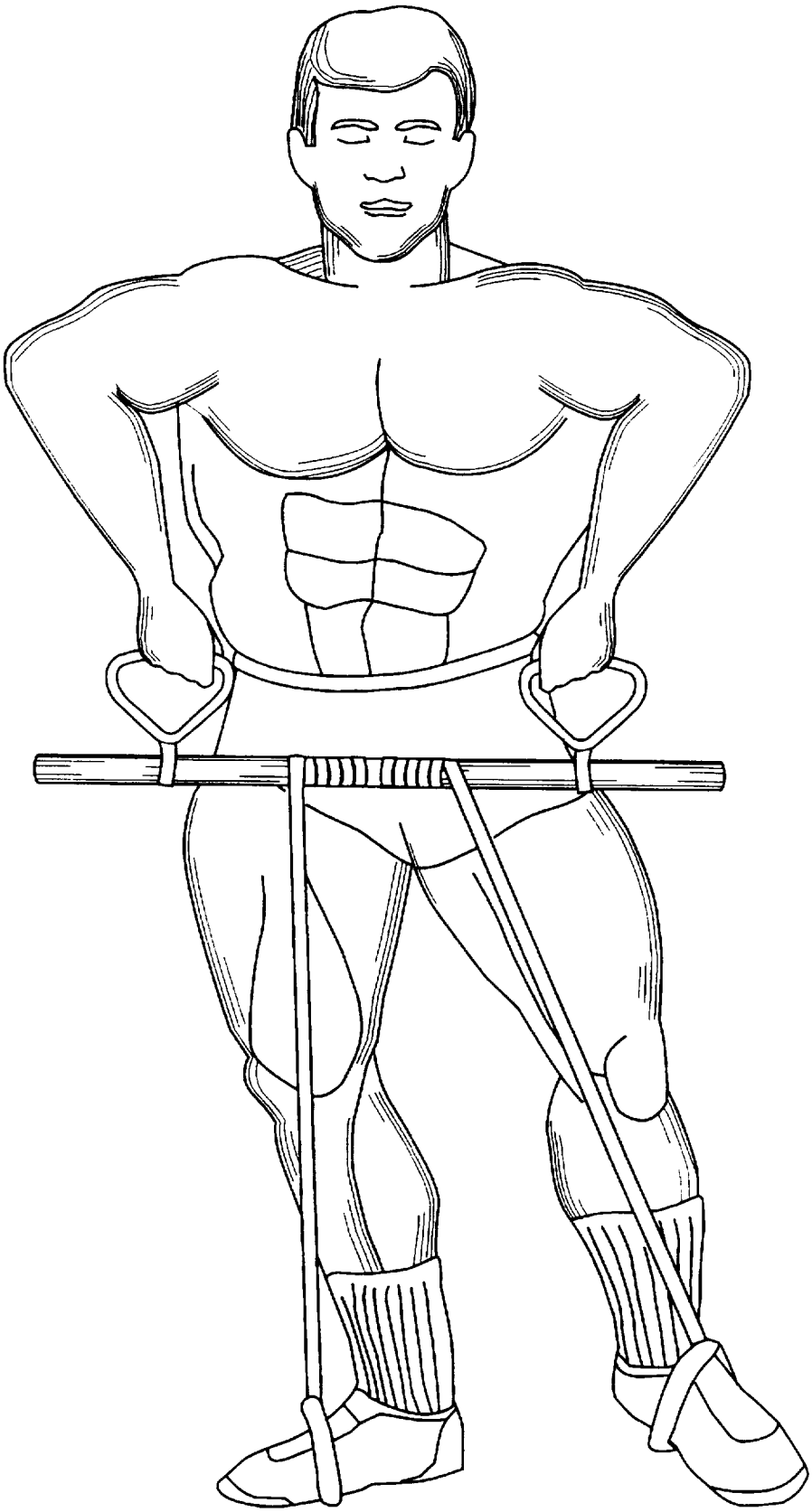
FIGS. 7–9 show a configurations or positions for using the device of FIGS. 2–6.

If a smaller person wants to use the device 10 to perform the same exercise, or if a larger biasing force is desired between the hands and the feet, all he has to do is to roll an upper portion of the hose sections 44 up on bar 20 until the desired length for member 14 is achieved. Note that because the member 14 is secured to the bar 12, the elastic member 14 will not unravel during exercise. By rolling or wrapping the flexible members on the bar, the position of the bar 12 may also be lowered as shown in FIG. 7. In this configuration, for example, the exercising person can lift his arms from a full extension to the position shown in FIG. 7 to thereby exercise the arms.

Figure 8:
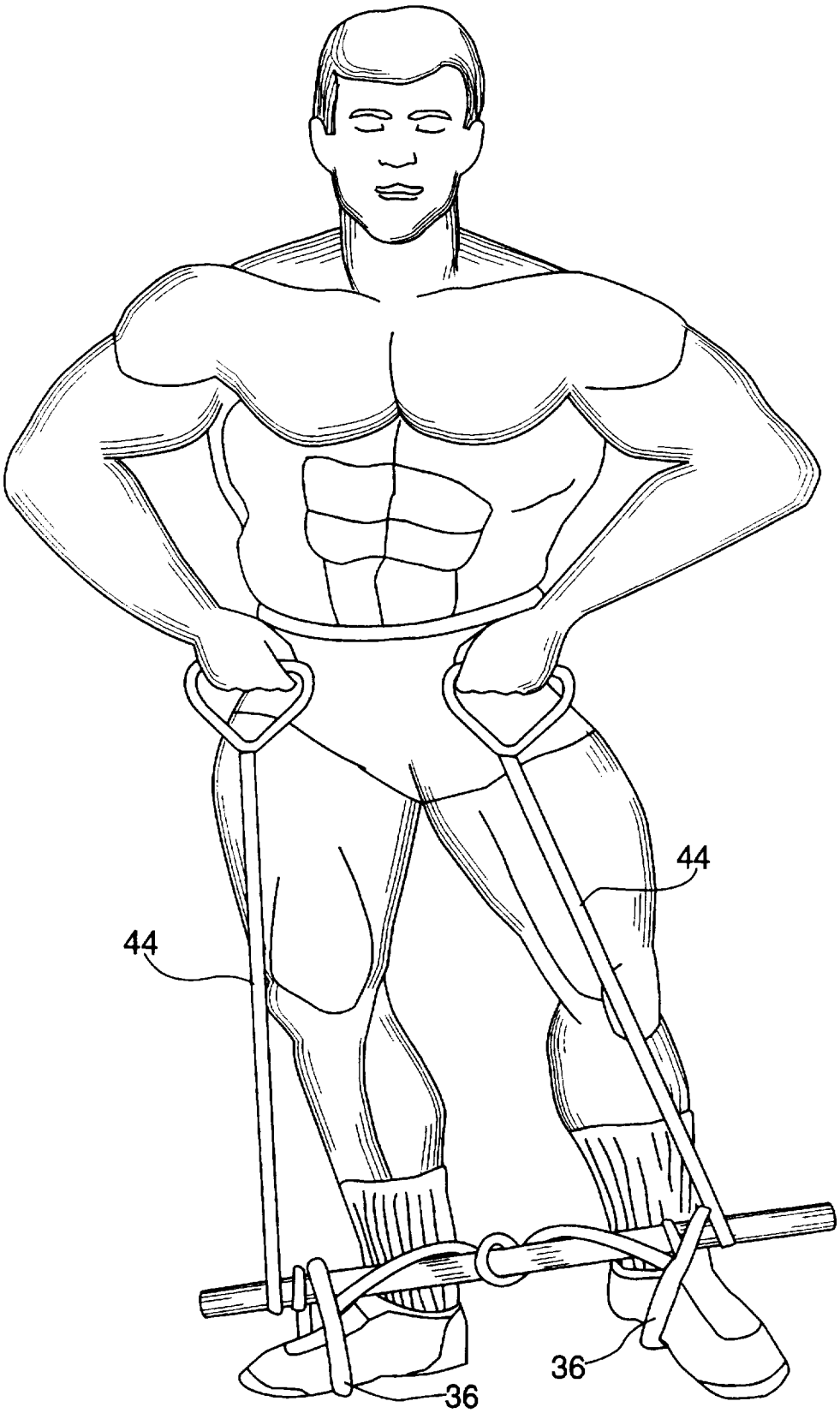

In the configuration of FIG. 8, the bar is disposed just above the feet with the loops 28 being trained about the feet. Importantly, in this configuration the elastic members first extend from the center horizontally to the loops 28 and then extend straight up to provide substantially vertical forces on the hands.

Figure 9:
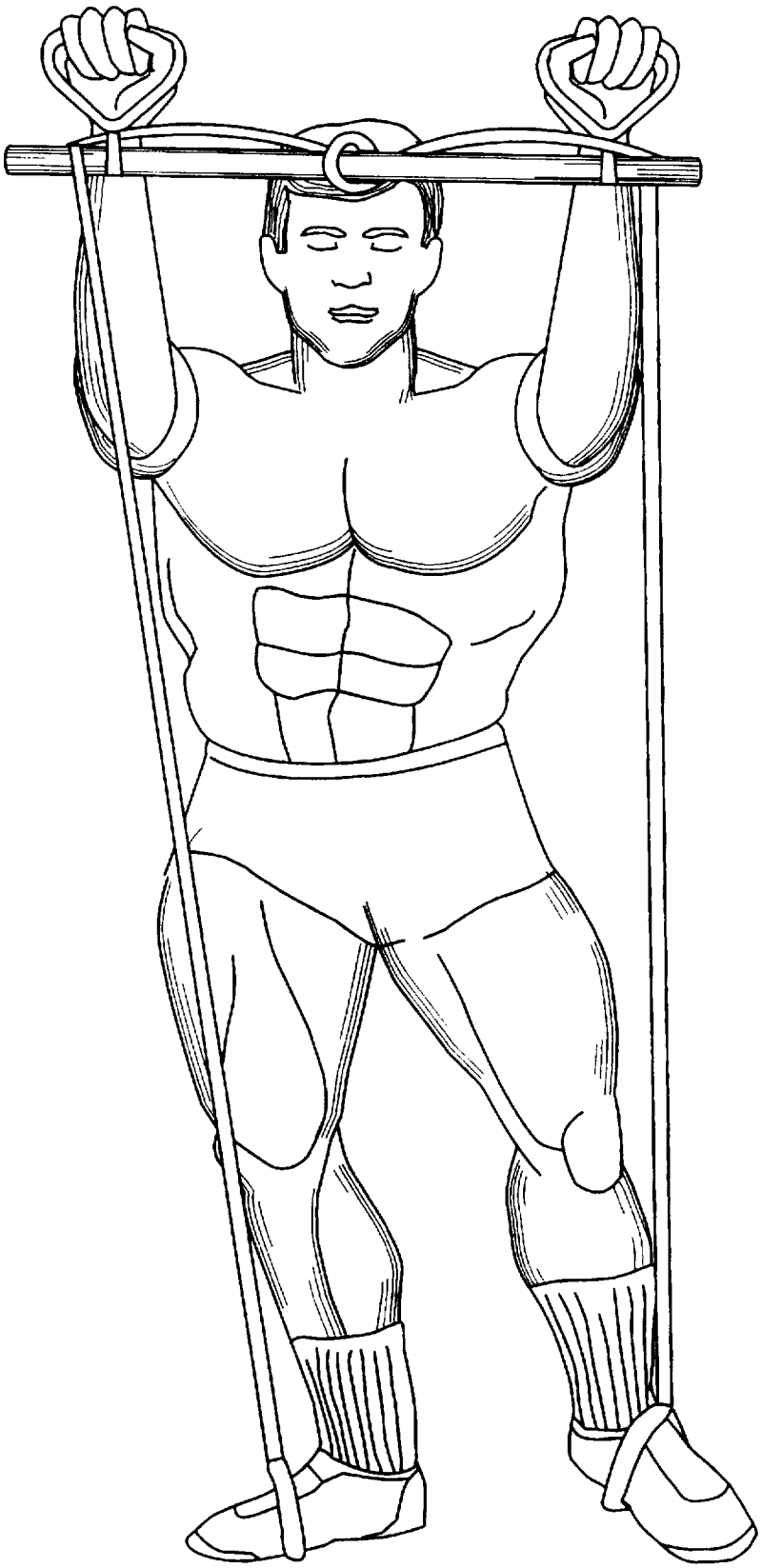

FIG. 9 shows a configuration similar to the on in FIG. 8 but with the bar being disposed adjacent to the hands rather than the feet. It should be noted that both configurations can be used either in the upright or supine position. However, additionally, the configuration of FIG. 8 allows the feet to move only together while the hands can move together or alternately. The reverse is true of FIG. 9.

Figure 10:
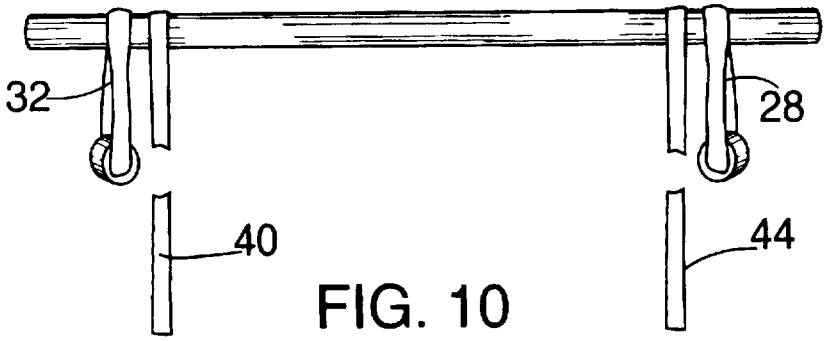
FIG. 10 shows an alternate embodiment of the invention.

In the alternate embodiment of FIG. 10, the two flexible members 14A, 14B are secured at separate locations to the bar 12 adjacent to loops 28.

In general, the exercising device is used for routines which require one of two configurations: (a) the legs move together while the hands wither move together or separately; or (b) the hands move together and the legs can move together or separately. For instance, in the position shown in FIG. 1 one routine involves holding the feet steady (i.e., the person remains stationary) while his arms move up and down at the same time lifting the bar 12 with both hands at the same time. This routine exercises the lower arms, and the shoulder muscles.

Another routine involves holding the bar 12 substantially steady with both hands while the legs are moved up and down alternatively. This routine exercise the muscles of the leg, in a manner similar to the expensive so-called 'climbing' exercising machines. It should be noted that either of the routines can be performed readily without any need for changing the position and orientation of the device or the user.

For yet next routine the device is reversed so that the bar 12 is adjacent to the feet with the loops 28 being disposed about the feet. Meanwhile, each of the hands holds one of the loops 46. In this arrangement, the user can lift and lower his hands and arms alternatively in a manner similar to lifting hand weights. This routine exercises the arm muscles. The hands can be also lifted together at the same time to simulate weight lifting.

In yet another configuration, while the person is in the supine position, he holds the bar in a relatively vertical position so that one of its ends touching on the floor. For this purpose the end may be provided with a cup for resting and pivoting with respect to the floor. The body can rock back and fourth using the bar end as a fulcrum point while the arms and/or legs are extended and retracted.

The many advantages of the invention are clear from the above description and drawings. One of its biggest advantages is that it can be realigned, readjusted or reconfigured in mere seconds from one exercise to another or from one user to another. Another advantage is that the force or tension applied or generated during any exercise is continuously variable because of the flexibility and elasticity of the limb engaging loops. A further advantage is that as opposed to the large equipment requiring distribution of various weights by trained personnel, the tension or force within the present invention is readily adjustable by merely wrapping or unwrapping some of the flexible members from the bar. This step is performed intuitively and almost automatically by a user without any need of special instructions, or training.

Yet another advantage is that by merely shifting from one hand or one foot to another. The device can thus be readily changed from one configuration to another to exercise first one muscle of the body and then another. Each exercise is self-adjusting to the height, strength and other preferences of each user, whereby each user can work on enhancing or establishing proper muscle definition. Advantageously, the device can be selectively used to achieve substantial muscle definition and endurance throughout the entire upper body, as well as the abdominal muscles, buttocks, and so on.

Numerous modifications may be made to this device without departing from the scope of the invention as defined in the following claims.

I claim:

1. An exercising device comprising:

an elastic filament having first and second filament ends, filament limb engagement elements and a central filament portion in between; and a stiff bar member having first and second bar ends, a bar central portion extending between said bar ends and first and second bar limb engagement elements spaced from said first and second bar ends respectively with said central filament portion being attached to said bar central portion wherein said bar limb engagement elements include loops.

2. The device of claim 1 wherein said elastic filament is made of a rubber tube.

3. The device of claim 1 wherein said filament limb engagement elements are made of loops.

4. The device of claim 1 wherein a first and a second handle is formed between said first and second bar ends and said first and second bar limb engaging elements respectively.

5. The device of claim 4 further comprising first and second sleeves on said bar defining said handles.

6. The device of claim 4 wherein said handles and said central bar portion are colinear.

7. An exercising device arranged and adapted to allow a person to perform a number of different routines, said device comprising:

a substantially stiff straight bar having two opposed bar ends and a middle portion disposed between said opposed bar ends and having a central point;

two bar limb engagement members disposed at said ends for engagement with the limbs of a person, said bar limb engagement members including loops; and a first flexible member having one section attached to said central point and a flexible member end with a flexible member limb engaging member.

8. The device of claim 7 further comprising a second flexible member attached to said central point having second member section attached to said central point and a second member end with a second member limb engaging member.

9. The device of claim 8 wherein said flexible members are elastic.

10. The device of claim 8 wherein said first and second flexible members are joined at said central point.

11. The device of claim 8 wherein said bar includes a hollow pipe.

12. The device claim 11 wherein said pipe is covered at said two bar ends with sleeves.

13. The device of claim 8 wherein said central point is spaced from said bar ends to allow said flexible members to be wound about said bar.

14. The device of claim 7 wherein said flexible limb engagement member includes a loop sized and shaped to fit a hand or a foot.

15. The device of claim 14 wherein said flexible member and said flexible limb engagement member are formed of a single continuous tubing.

16. The device of claim 15 wherein said tubing is elastic.

17. An exercise device comprising:

two flexible elements, each having first and second flexible element ends, the first flexible element ends being joined at a common point and the second flexible element ends terminating in corresponding flexible element limb engaging members; and a stiff bar having a length selected to accommodate said flexible elements by winding said flexible elements on said bar, said bar having two bar ends and a mid point disposed halfway between said bar ends, said common point being attached to said midpoint, said stiff bar further including two bar limb engaging members including loops.

* * * * *